US005416251A

United States Patent [19]

Lomasney et al.

[11] Patent Number: 5,416,251

[45] Date of Patent: May 16, 1995

[54] METHOD AND APPARATUS FOR THE SOLIDIFICATION OF RADIOACTIVE WASTES AND PRODUCTS PRODUCED THEREBY

[75] Inventors: Henry L. Lomasney; Michael A. Lomasney, both of New Orleans; Robert R. Bridges, Covington; Richard A. Graves, New Orleans, all of La.

[73] Assignees: Monolith Technology Incorporated, New Orleans, La.; Scientific Ecology Group, Oak Ridge, Tenn.

[21] Appl. No.: 30,803

[22] Filed: Mar. 12, 1993

[51] Int. Cl.[6] ..... A62D 3/00

[52] U.S. Cl. ..... 588/255; 405/128; 588/252; 264/DIG. 69; 141/263

[58] Field of Search ..... 405/128, 129; 588/252; 264/DIG. 69, 109; 141/263, 264

[56] References Cited

U.S. PATENT DOCUMENTS

| | | | |
|---|---|---|---|
| 3,367,992 | 2/1968 | Bearden | 260/837 |
| 3,442,842 | 5/1969 | von Bonin | 260/29.2 |
| 3,792,006 | 2/1974 | Najvar | 260/29.6 |
| 4,077,901 | 3/1978 | Arnold et al. | 252/301.1 |
| 4,131,563 | 12/1978 | Bähr et al. | 252/301.1 |
| 4,148,745 | 4/1979 | Rudolph et al. | 252/301.1 |
| 4,156,658 | 5/1979 | Mercer, Jr. et al. | 252/301.1 |
| 4,167,491 | 9/1979 | Gablin et al. | 252/301.1 |
| 4,337,802 | 7/1982 | Kennedy et al. | 141/264 X |
| 4,919,569 | 4/1990 | Wittenzelliner | 405/128 |
| 5,275,508 | 1/1994 | Hansen | 405/128 X |

OTHER PUBLICATIONS

SETH-200, "A New Mobile Machine For Embedding Spent ION-Exchange Resins In Polymers," Mar. 1985.

Specification "Ion Exchange Resin Immobilization System," Technicatome, pp. 15–20 and 3 pages of drawings, Jun. 1987.

X. Augustin, et al., "French Processes For Waste Embedding the Use of Epoxy Resin For Waste Containment," Technicatome, Gif sur Yvette, France, C402/88, 1988.

"Thermosetting Resin Embedding System," Technicatome, 1985.

*Primary Examiner*—Dennis L. Taylor

[57] ABSTRACT

Methods for the encapsulation and solidification of waste material, particularly radioactive ion exchange resin bead media, are provided along with the apparatus to accomplish the methods, and the final encapsulated storage article. The ion exchange resin is solidified within a containment vessel by the addition of a thermosettable polymeric binder without the need for a premixing vessel. The resulting exothermic conditions occasioned by the curing of the polymer are controlled by the sequential delivery of the polymeric binder, preferably through an injection lance.

21 Claims, 1 Drawing Sheet

METHOD AND APPARATUS FOR THE SOLIDIFICATION OF RADIOACTIVE WASTES AND PRODUCTS PRODUCED THEREBY

FIELD OF THE INVENTION

The present invention relates to containment of radioactive waste materials. More specifically, the invention relates to encapsulation of ion exchange resin in a thermosettable polymeric binder.

BACKGROUND OF THE INVENTION

The nuclear power industry utilizes aqueous solutions within the reactor side of the nuclear reactor to transfer energy from the reactor core to the electrical generators. These solutions often become radioactive and must be treated to reduce the level of radioactivity. Generally, the solutions are processed through mixed ion exchange beds containing both cationic and anionic resin material. The resin material contains anionic and cationic exchange sites and these sites are termed "active" if they have not been replaced by an ionic moiety, such as a radioactive species, and "exhausted" if they have been replaced by an ionic moiety. Commonly, the resin bed material is removed from service prior to the complete exhaustion of the resin material. This partially exhausted ion exchange resin must then be disposed of as a radioactive waste, which wastes are highly regulated by governmental agencies. Particular problems associated with disposal of ion exchange media include the need to remove excess residual water while maintaining the resin in a "swollen" or wet state for long term burial, and the nature of the resin material which may still be partially active.

The nuclear waste industry has developed various ways for disposing of radioactive ion exchange resin. Problems associated with its disposal are related to its capacity for further ion exchange and its consistency as resin beads which are sand-like in nature. Examples of disposal techniques include incineration, solidification in concrete, confinement of the resin beads in a high integrity container, and solidification in polymeric materials. Ultimately, these treated wastes are buried in regulated burial sites.

Incineration is generally not preferred due to its equipment requirements that translate into high operating costs. Also, incineration produces secondary radioactive wastes, such as fly ash and off-gases, that require additional treatment. Further, the high sulfur content of the resin beads has presented problems with damage to the incinerator vessel.

Solidification with concrete is undesirable due to the increase in waste volume and weight. Further, the resin beads tend to interfere with the concrete chemistry and cause weaknesses in its structural integrity.

The use of high integrity containers is in many ways satisfactory, however the ion exchange resin is in a loose state and can be easily released into the environment in case the container vessel is damaged. The resin can also escape if a fire should damage the container.

In the recent past, considerable interest has been focused on the area of resin treatment that results in its solidification with polymeric binders. Examples of earlier methods are shown in U.S. Pat. No. 4,077,901 to Arnold et al. and U.S. Pat. No. 4,167,491 to Gablin et al. in which the waste ion exchange material is stirred into the polymeric binding material within a containment vessel. The stirring is continued for a short period of time after which the stirring means is discontinued and the polymer allowed to cure within the vessel. This system is disadvantageous in that the entire mass of waste material and polymeric binding material must be admixed prior to curing of the polymer. Since the polymer curing is an exothermic reaction, a potentially dangerous situation arises where the contents of the container could reach an unsafe temperature, and even lead to a fire. If less polymer catalyst, or curing agent, is added to try to control the exotherm, with the optional introduction of additional curing agent after initial mixing, the resulting solidification process may not be uniform, there is still the chance for an uncontrolled exotherm upon the introduction of additional curing agent, and there may not be adequate time for mixing due to the pot life of the polymeric mixture. This method also produces an undesired secondary waste in the form of the mixing apparatus, which could be left in the container as shown in Gablin et al., which is not economical.

Another processing method is to first admix the waste ion exchange resin and polymeric materials in a blending vessel and subsequently transfer the contents to another containment vessel. This process is shown in Gablin et al. and also commercially used in the French SETH 200 process available from Technicatome. The ion exchange material is first placed into the vessel and then the polymeric reagents are blended into that material using conventional mixing techniques. The mixer is then removed and the polymer allowed to cure. As discussed with the other method, this method produces an entire ion exchange/polymer resin mass before the exothermic curing reaction. Such a situation is dangerous due to the possibility of an uncontrollable exothermic reaction. These processes also do not lend themselves well to relatively large disposal vessels due to the presence of the large mass of potentially dangerous reactant polymeric material.

The efforts of later development work centered around perfecting these "in-containment" processes in which the ion exchange media and polymeric material were both placed into one containment vessel for both mixing and storage. One embodiment was developed in which the ion exchange resin was first added into the containment vessel and the polymeric binding material was introduced into the top of the vessel while a vacuum was pulled from the bottom of the vessel. The polymer and its curing agent were thus drawn through the void spaces in the ion exchange resin until the polymer mixture contacted the vacuum orifice. The polymer mixture was chosen to be hydrophobic and would displace the residual water that is hydrated on the surface of the swollen ion exchange media. This process also had problems. First, the concept required that the polymer and its curing agent could transit the entire length of the disposal vessel through the tightly packed resin bed within the pot life of the polymer system, which was not always the case. Second, the activated polymer mixture was observed to be reactive with the ion exchange resin. Essential reactive species from the polymer mixture were removed during transit through the resin material; thus the polymer mixture reaching the bottom of the vessel was not in proper stoichiometric proportion. It has been found that trying to pretreat the resin bed to exhaustion to remedy this situation resulted in the liberation of radionuclide species creating a radioactive secondary waste. Also, trying to anticipate a loss of reactive species by overloading the curing agent would lead to unacceptable exotherm conditions. Finally, the polymer mixture, upon being pulled through the resin matrix, would tend to be channeled through certain passages causing incomplete matrix formation.

A need therefore exists to develop a process for the encapsulation of waste radioactive ion exchange resin that can be accomplished within the containment vessel itself without the need to mix the entire mass of ion exchange resin and encapsulating polymeric material prior to the curing of the polymeric material. A further need exists for a process that effectively preconditions the ion exchange resin prior to the encapsulation process so that undesired reactions between ion exchange media and the encapsulating polymeric material does not occur.

SUMMARY OF THE INVENTION

The present invention provides for the encapsulation and solidification of waste materials, preferably radioactive waste materials, more preferably ion exchange resin, within one containment vessel, or via an "in-containment" process. The waste material is encapsulated in a thermosettable polymeric binder in a process which controls the highly exothermic polymer curing reaction. The resulting encapsulated ion exchange resin/-polymer binder matrix is a uniform encapsulation of the ion exchange resin and has a relatively high compressibility. The present invention provides for the improved encapsulation method, the apparatus to practice the method, and the final encapsulated product.

In one embodiment of the invention, a burial container is provided that has a waste material, preferably an ion exchange resin and an aqueous liquid, disposed therein with the container having a bottom section and an upper section. Also provided is a polymeric binder that is a thermosettable polymeric resin and a curing agent for that resin. The polymeric resin is initially introduced into the waste material at a point proximate to the bottom section of the container. Subsequently, the polymeric binder is introduced into the waste material at a plurality of points that are sequentially farther from the bottom section towards the upper section of the container. The polymer binder can therefore undergo sequential curing to form the final encapsulated waste product which is ready for long term storage.

The aqueous liquid is preferably displaced from the ion exchange resin material prior to the introduction of the polymeric binder. This displacement is accomplished by introducing a hydrophobic liquid, preferably containing a non-polar polymer such as polyisobutylene, into the ion exchange resin. The polyisobutylene acts to form a protective film coating around the ion exchange resin so that it will not inhibit or interfere with the later polymeric binder introduction and curing steps.

The preferred method for introducing the polymeric binder is through an injection lance that is inserted through the upper wall of the containment vessel and extends to the bottom wall of the vessel. The introduction of the polymeric binder is initiated at a point proximate to the bottom wall. The polymeric binder is selected to have a density greater than that of the aqueous liquids and displacement liquids remaining in the ion exchange resin. This forces any residual liquids upward with the polymeric binder filling in the resulting void spaces in the ion exchange resin. The lance is then withdrawn from the vessel to a predetermined point at which the introduction of polymeric binder is continued, and this process is repeated until the polymeric binder occupies the free liquid void space within the vessel and any other liquids are displaced upward and out of the vessel.

The present invention also provides for the apparatus to accomplish the processes. The improved apparatus for encapsulating radioactive ion exchange resin is a containment vessel having a bottom and an upper wall with a retractable injection lance for supplying a thermosettable polymeric binder. The lance has a body portion and a distal end and is configured so that it enters the vessel through the upper wall and extends into the vessel to the extent that the distal end of the lance is proximate to the bottom wall.

The present invention also provides for an improved storage article for the safe containment of radioactive waste ion exchange resin. The ion exchange resin is in intimate contact with a hydrophobic, non-polar polymer, preferably polyisobutylene, that is chemically inert to an epoxy-based resin. The ion exchange resin and non-polar polymer are solidified within a matrix of polymerized epoxy-based resin.

DETAILED DESCRIPTION OF THE INVENTION

The present invention provides for improved processes for the controlled and efficient encapsulation of waste materials, particularly radioactive waste materials, and especially ion exchange resin materials, in a thermosettable plastic material. The present invention also provides process systems for carrying out the processes and for the encapsulated product produced by the processes. The present invention provides for an "in-containment" system in which the ion exchange resin is encapsulated in the same vessel in which the polymeric binding material is admixed with the resin, thus reducing auxiliary mixing equipment and the production of excess secondary wastes. The present invention also provides for the removal of residual "free" water associated with the resin material, while also providing for the encapsulation of the resin material in its swollen state.

The waste materials which can be encapsulated by the present processes are diverse. Common wastes include radioactive wastes generated by nuclear power facilities. Representative waste materials include those set forth in U.S. Pat. No. 4,131,563 to Bähr et al. which is incorporated herein in its entirety. Wastes that are particularly well suited for encapsulation by the processes are ion exchange resins that are commonly used to purify water streams within a nuclear reactor.

Figure 1:
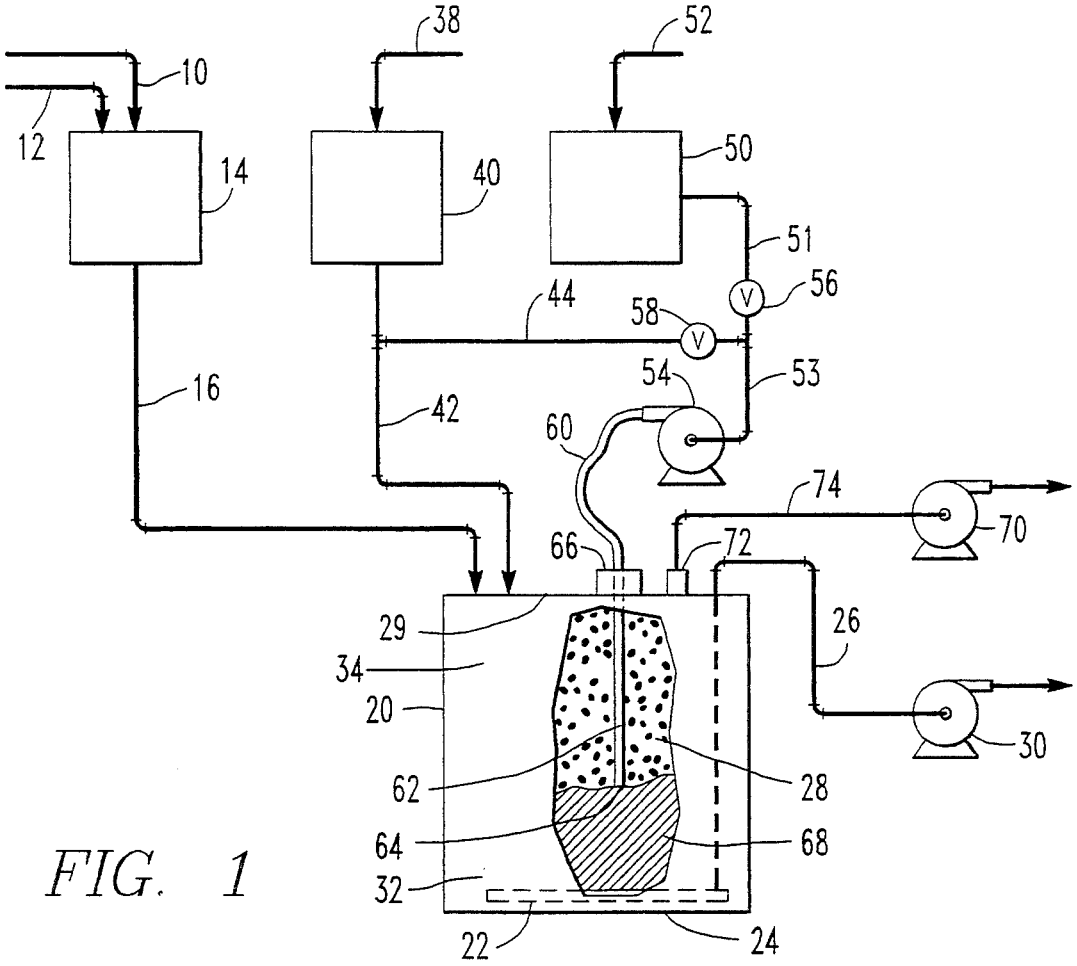
FIG. 1 is a schematic process flow diagram, with a partially cut-away view of the containment vessel, of the present invention.

The present invention can be more fully explained by reference to FIG. 1. Waste ion exchange resin material is transferred via line 10 into the feed tank 14. Commonly, water or other aqueous liquid, transported by line 12, is admixed with the resin material in the feed tank 14 to prepare a sluice feed slurry. This feed slurry is then transferred via line 16 into the containment vessel 20. The containment vessel 20 can be any commonly used container for storage of radioactive materials. The vessel 20 is preferably outfitted with a drainage mat 22 located near the bottom of the vessel 20, preferably on the bottom of the vessel 20 against the bottom wall 24. During the transfer of the sluice feed slurry excess aqueous fluid is removed from the vessel 20 by operation of pump 30 which draws the excess fluid through the mat 22 and line 26. The mat 22 can be made of any materials that will allow transmission of aqueous fluid, but not the sand-like ion exchange resin 28. A commercially available mat 22 is sold under the name GRUNDNET manufactured by Gundle Lining Systems, Inc. and is a net material prepared of overlapping polyethylene strands. The sluice feed slurry is fed into the vessel 20 until the ion exchange resin 28 fills the vessel 20.

In the case where the ion exchange resin material 28 is not completely exhausted, it is preferred to remove excess water that is entrained with the ion exchange resin 28 prior to the encapsulation process. This pretreatment can be accomplished by introducing a displacement solution, a hydrophobic solvent, into the ion exchange resin 28 and removing the displaced water. The displacement solution can be any type of hydrophobic solvent composition which is not chemically incompatible with the polymeric materials used for encapsulation. Typically, the displacement solution contains petroleum distillate products such as petroleum or mineral spirits, or naphtha, preferably petroleum spirits. The displacement solution can also contain small amounts of other additives to improve the hydrophobic nature of the solution such as aluminum stearate. Generally, the displacement solution contains at least about 80% and preferably at least about 85% by weight petroleum spirits and up to about 5%, preferably from about 0.1–3% by weight of aluminum stearate. The displacement solution can also include caustic solutions, however these solutions are not preferred due to their tendency to interact with the ion exchange resin 28.

A preferred displacement solution also contains an additive compound that can form a protective barrier around the ion exchange resin 28 and thus inhibit any interaction between the ion exchange resin 28 and the polymer material used for the encapsulation. The additional compound should be non-polar and hydrophobic, it should be resistant to moisture, have adhesive characteristics, and be flowable when admixed with a petroleum-based displacement solution. A preferred additive is polyisobutylene which has been found to form a protective coating around the resin material and thus greatly inhibit interaction between a partially active resin bed material and the encapsulating polymer material. The polyisobutylene can be admixed in the displacement solution in amounts up to about 30%, preferably from about 3–10% by weight. Other agents can be added into the displacement solution to aid the film forming characteristics of the polyisobutylene, such as α-methyl styrene polymer having a molecular weight of about 1200, which can be added in amounts up to about 15%, preferably from about 5–10% by weight. The displacement solution compounds are fed into the tank 40 via line 38.

The displacement process is accomplished by introducing the displacement solution from the tank 40 into the vessel 20 via line 42. When the density of the displacement solution is less than that of water, or less than about 1, it is preferred to introduce it near the upper wall 29 of the vessel 20. The pump 30 is advantageously employed during this stage of the process to remove the interstitial water in the ion exchange resin 28 via line 26. The displacement solution flows behind the exiting water temporarily occupying the void spaces within the ion exchange resin 28. This process step aids in removing "free" water from the ion exchange resin 28, and, when the additional film forming compound, such as polyisobutylene is used, the ion exchange resin 28 is further prepared for the later encapsulation.

The polymeric binder can be incorporated into the ion exchange resin 28 at this point in the process. The polymeric binder generally consists of a polymer resin and a curing agent for that resin. The polymer resins that can be used in the process are thermoset polymers such as epoxy resins and vinyl ester resins having relatively low molecular weights. The polymer resins should have a low viscosity upon mixing and can be formulated with crosslinking species that provide a low viscosity for the polymer mixture during the injection of the polymer mixture into the containment vessel. The viscosity of the polymer mixture is generally below about 1 poise, more preferably below about 0.5 poise, and more preferably below about 0.4 poise. The density of the polymeric binder is preferably greater than that of the displacement solution, and more preferably greater than 1.

The polymer resin is preferably an epoxy resin and the curing agent preferably contains amine functionality. The epoxy resin is preferably a bisphenol-A epoxy and has an epoxy equivalent weight range of below about 210, preferably about 160–210, more preferably about 185–205. Examples of such epoxy resins are the EPON 828 and EPON 830 available from Shell Chemical Company. The amine curing agent can be selected from those commonly used to cure such epoxy resins, preferably aromatic amines, aliphatic amines, and polyamide compounds, along with mixtures thereof. Preferred aromatic amines have amine values of about 305 and a viscosity of about 1.5 poise, and are available commercially as ANCAMINE MCA; preferred aliphatic amines are unmodified compounds such as triethylene tetraamine commercially available as TETA; preferred polyamides are mixtures of fatty acids and amines such as ANCAMIDE 400, all of these being manufactured by Air Products & Chemical Company. It has been found that the longer chain polyamide compounds are more desirable than the relatively low molecular weight amine species such as diethylene tetraamine which are very mobile and easily lost to the ion exchange resin.

The epoxy resin and amine functionality compound are blended such that the amine values exceed the theoretical stoichiometric epoxide values up to about 10 percent, preferably from about 3 to about 5 percent. The weight ratios of the various types of amine functionality compounds and the epoxy resin can thus vary depending upon the mixture of amine compounds.

The viscosity of the epoxy resin and curing agent mixture can be lowered by the addition of a diluent or plasticizer compound. Examples of such compounds include mono-epoxide species such as alkyl glycidyl ethers, commercially available as NC-513 from Cardolite Chemical Company, and di-functional diluent such as neo-pentyl glycidyl ether, commercially available as WC-68 from Rhone Poulenc.

The increase in the temperature within the ion exchange resin bed during the polymer curing process can be slightly mitigated by the incorporation of non-reactive polymer species in the polymeric binder. These compounds must be compatible with the epoxy resin and examples include aromatic oils, and styrene compounds such as styrene and α-methyl styrene. The aromatic oils are generally petroleum hydrocarbon resin materials containing a mixture of high boiling aromatic hydrocarbons having a flash point of about 125° C., and are commercially available as AROMATIC OIL 745 PLASTICIZER from Neville Chemical Company. The aromatic oil can be present in the polymeric binder in amounts up to about 20%, preferably from about 10–20% by weight. The styrene compound can be present in amounts up to about 10%, preferably from about 3–7% by weight.

Other polymeric binder compositions that can be employed in the process of the present invention are those compositions set forth in U.S. Pat. Nos. 4,167,491; 4,131,563; and 4,077,901; all of which are hereby incorporated in their entireties by reference.

The constituents of the polymeric binder are added into tank 50 via line 52 and blended to create a homogeneous mixture. The polymeric binder is transferred from tank 50 through lines 51 and 53 by pump 54 into the vessel 20. The polymeric binder is introduced into the ion exchange resin 28 in a specific manner to avoid the potentially dangerous situation of a large mass of exothermic curing polymer resin. The addition of the polymer binder is controlled by beginning the introduction at a point near the bottom section 32 of the vessel 20, preferably proximate to the bottom wall 24, most preferably within about 15 cm (6 in.) of the bottom wall 24. During the course of the polymeric binder introduction, the binder will tend to push away the residual less dense displacement liquid from the interstitial spaces in the ion exchange resin 28. The polymeric binder thus encapsulates the ion exchange resin 28 providing an encapsulated mass 68. The evacuated liquids, primarily displacement liquid, forced out of the ion exchange resin 28 by the incoming polymeric binder are removed from the vessel 20 via line 74. Optionally a pump 70 can be employed to create a reduced pressure within the vessel 20, preferably from about 250 mm Hg (10 in.) to about 630 mm Hg (25 in.) negative gauge pressure. Optionally, a site 72 can be used to monitor this process. The polymeric binder, after filing the void space around the ion exchange resin 28 near the bottom of the vessel 20, is subsequently repeatedly introduced at points sequentially farther distant from the bottom towards the upper section 34 of the vessel 20. This progressively upward addition, which can be continuous or intermittent, provides for the supplying of the polymer binder in a manner such that the residual liquid in the ion exchange resin 28 is forced upward and is replaced by the fresh liquid polymer binder. The process is continued until the introduction of the polymeric binder is proximate to the top wall 29 of the vessel 20 and the polymeric binder begins to exit the vessel 20 via line 74.

The preferred delivery mechanism for introducing the polymeric binder into the vessel 20 in the progressively upward fashion is an injection lance 62. The lance 62 is connected to a flexible hose 60 to allow for its insertion and withdrawal from the vessel 20. The polymeric binder is transferred from the tank 50 through the pump 54 and hose 60. The lance 62 is positioned proximate to the bottom wall 24 at the beginning of the introduction process, preferably in contact with the bottom wall 24 or with the mat 22 if it is used. The polymeric binder is introduced through the lance end 64 to create the encapsulated mass 68. The lance 62 is slowly withdrawn from the vessel 20 as the polymeric binder fills void space surrounding ion exchange resin 28. The lance 62 can be moved to various selected points along the height of the vessel 20 and introduction continued at that point for a specified period of time, or the lance 62 can be continuously withdrawn at a selected rate. The lance 62 is withdrawn through a tightly fitting seal 66 which acts to clean the lance 62 thus reducing its radioactive content.

The rate of polymeric binder addition, and corresponding relocation of the lance end 64, are easily determined by those skilled in the art based upon the volume of the container, the feed rate of the polymeric binder and its flow characteristics, among other variables. In a preferred embodiment the polymeric binder is introduced under an alternating positive pressure to enhance its flow into the void space in the resin material 28.

The introduction of the polymeric binder is regulated to control the exotherm created by the curing polymeric binder. Generally, the temperature within the vessel 20 is maintained at below about 100° C., preferably below about 80° C., more preferably below about 65° C., assuming that the resin material is between about 22°–30° C. prior to the introduction of the polymeric binder. This temperature can also be regulated to some extent by outside means such as cooling the ion exchange resin 28 prior to encapsulating or employing cooling devices such as vessel cooling jackets, however these steps and devices are not required by the present processes.

The process can also be conducted using a displacement solution having a density greater than that of water, or greater than about 1. The ion exchange material is fed into the vessel 20 in the same manner as discussed previously. The displacement solution is now added into the vessel 20 proximate to the bottom wall 24 to force the less dense water within the ion exchange resin 28 upward. Referring to FIG. 1, the displacement solution is transferred via line 44 and line 53 by means of pump 54 into the vessel 20. The valve 56 is closed and valve 58 is open during this process. The lance 62 can be used for the addition of the displacement solution and the lance 62 is extended fully to the bottom of the vessel 20. The displacement solution is added and the displaced water removed via line 74, optionally with the aid of pump 70 until the displacement fluid fully occupies the void space within the ion exchange resin 28. The polymeric binder is introduced into the vessel 20 at this point by closing valve 58 and opening valve 56 allow flow through lines 51 and 53. The lance end 64 is adjusted as discussed previously to provide the encapsulated material 68 within the vessel 20.

Figure 2:
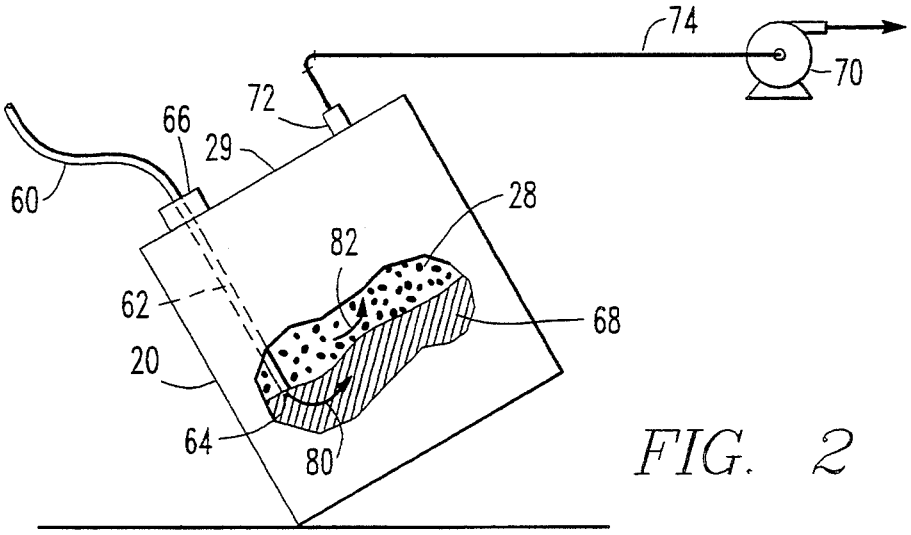
FIG. 2 is a partially cut-away view of the containment vessel in a preferred polymeric binder introduction orientation.

The polymeric binder is preferably introduced into the vessel 20 while the vessel 20 is oriented in a position other than vertical. Referring to FIG. 2, the vessel 20 is tipped off vertical to an angle of about 10°, preferably about 20°, more preferably about 30°, to allow for more effective polymeric binder addition. The polymeric binder 80 exits the lance end 64 and forces the liquids 82 within the ion exchange resin 28 upward. The tilted orientation enhances the flow of the liquids 82 to the upper portion of the upper wall 29. The liquids 82 are then removed through line 74, optionally with the aid of pump 70.

The final encapsulated ion exchange resin/polymeric binder matrix is uniform in nature. There is a relatively small quantity of "free water" and the product is safe for long-term disposal. The matrix has a high compressibility of at least about 1000 psi.

EXAMPLES

Example 1

A 55-gallon steel drum was filled to capacity with a mixed bed ion exchange resin slurry. The slurry mixture consisted of two parts of an anion media to one part cation media. The excess free water in the slurry was removed by pumping the water out of the container through a mat located at the bottom of the drum. When the drum was filled to capacity, the pumping of the feed slurry was discontinued, and the removal of the excess free water was continued for about 2 hours until all pumpable water was removed.

A displacement liquid was prepared containing 85% by weight mineral spirits, 3% by weight aluminum stearate, 3% by weight polyisobutylene, and 9% by weight petroleum hydrocarbon resin having a molecular weight of about 1,200. Ten gallons of this displacement liquid was introduced into the top of the drum, while a suction pump operated to remove liquids from the drum through the mat. The pumping of liquids through the drainage mat was continued for over an hour to permit the evacuation of any residual liquids that migrate slowly under gravity into the drainage mat.

Approximately 25 gallons of a liquid polymeric binder mixture were prepared. This mixture contained approximately 46% by weight bisphenol-A epoxy, Epon 828 (Shell Chemical Company), 18% by weight aromatic oil, 5% by weight styrene, 14% by weight aromatic amine, 13% by weight low molecular weight polyamide, and 4% by weight tertiary amine curing agent. The polymeric binder was prepared in a manner such that the amine components were combined with the epoxy just prior to the beginning of the injection process.

A reduced pressure condition was created on the drum to provide a pressure within the drum of about 350–560 mm Hg (14–22 in.) negative gauge pressure. The liquid polymeric binder was introduced into the drum via a stainless steel tubular injection lance, which was approximately 92 cm. (36 in.) in length and approximately 0.48 cm (3/16 in.) inside diameter with 0.16 cm (1/16 in.) wall thickness. The lance was positioned within the drum, so that it was contacting the underdrain mat. The liquid polymeric binder was then introduced into the drum by means of a peristaltic pump connected with flexible silicon rubber tubing to the lance. As the epoxy level rose within the drum, it became apparent that the residual water and displacement liquid was "floating" on the polymeric binder. The liquids displaced by the polymeric binder were removed from the drum via piping connected to the pump used to create the low pressure within the drum. The drum was inclined at an angle of approximately 30° off vertical during the introduction of the polymeric binder. The take-off point for the displaced liquid was positioned so that it was coincident with the highest point on the top of the drum. Approximately 20 gallons of the polymeric binder was incorporated into the drum with the remainder being carried out along with the displaced liquids.

The drum contents were allowed to cure for approximately 24 hours at which time the walls of the drum were removed from the cured waste mass. The solidified waste mass was observed to have excellent integrity with the ion exchange bead media tightly bound by the epoxy material. The waste mass was cut along a cross section to reveal a uniform, cured polymer mass.

Example 2

The solidification of an ion exchange media was conducted in a high-integrity polyethylene container using the process of the present invention. The container was approximately 89 cm (35 in.) in diameter and 124 cm (49 in.) in height with wall thickness of about 1.3 cm (0.5 in.). The interior volume of the container was approximately 564 l (149 gal.).

The ion exchange media was fed into the container as set forth in Example 1. The ion exchange media was pre-treated with the displacement solution set forth in Example 1. The volume of displacement solution used was 114 l (30 gal.). The liquid polymeric binder used for the solidification process was the same as that described in Example 1, the quantity of liquid polymeric binder introduced into the container was 265 l (70 gal.). The pumping of water from the drum was discontinued at a point that caused the water level to remain about 5 cm (2 in.) below the top of the vessel. The displacement solution was drained into this dewatered area and continuously supplied.

During the introduction of the polymeric binder and the subsequent solidification process, the temperature of the bulk mass inside the container was monitored using thermocouples positioned within the container. One thermocouple was located near the container center, while another was located near the container side wall, approximately mid-way between the bottom and top of the container. The temperature at the center of the container was observed to climb steadily and after the liquid polymeric binder contacted this area, the temperature increased steadily for a period of approximately 50 minutes, reaching a maximum of 182° F. The temperature slowly declined over the next 24 hours, reaching a temperature of approximately 80° F. The container walls were stripped away, and the solidified waste mass was sectioned to reveal a uniform, solidified ion exchange bead mass. The compression strength of the resulting waste mass was approximately 1,000 psi.

We claim:

1. An improved method for encapsulating waste materials containing aqueous solutions, comprising:

(a) providing a burial container having a waste material comprising radioactive ion exchange resin and an aqueous liquid disposed in the container, the container having a bottom section and an upper section;

(b) providing a polymeric binder comprising a thermosettable polymeric resin and a curing agent for the polymeric resin;

(c) initially introducing the polymeric binder into the ion exchange resin at a point proximate the bottom section of the container;

(d) subsequently, introducing the polymeric binder into the ion exchange resin at a plurality of points sequentially farther from the bottom section towards the upper section of the container; and (e) curing the polymeric resin.

2. The method of claim 1 further comprising displacing aqueous liquid from the ion exchange resin prior to the introduction of the polymeric binder.

3. The method of claim 2 wherein the displacing is accomplished by introducing a hydrophobic liquid comprising a non-polar polymer into the ion exchange resin.

4. The method of claim 3 wherein the non-polar polymer comprises polyisobutylene.

5. The method of claim 4 wherein the polymeric resin comprises an epoxy resin and the curing agent comprises an amine compound.

6. The method of claim 5 further comprising creating a sub-atmospheric pressure condition in the container during the introduction of the polymeric binder.

7. The method of claim 1 further comprising providing an injection lance having a distal end and inserting the distal end of the lance into the ion exchange resin to a point proximate the bottom of the container, wherein the initial introduction of the polymeric binder into the container is through the distal end of the lance positioned at this point.

8. The method of claim 7 wherein the subsequent introduction of the polymeric binder is accomplished by withdrawing the lance from the container.

9. The method of claim 1 further comprising positioning the container in an orientation other than vertical prior to the introduction of the polymeric binder.

10. The method of claim 1 further comprising introducing the polymeric binder under an alternating positive pressure.

11. The method of claim 1 wherein the introduction of the polymeric binder is continuous.

12. The method of claim 1 further comprising controlling the temperature of the curing process below about 80° C.

13. An improved method for encapsulating radioactive ion exchange waste material containing aqueous solutions, comprising:

(a) providing radioactive ion exchange resin waste material and an aqueous liquid in a burial container, the container having a bottom wall and an upper wall, and also providing a removable injection lance capable of carrying liquids positioned within the container, the lance having a distal end;

(b) providing a polymeric binder comprising a thermosettable polymeric resin and a curing agent for the resin;

(c) positioning the distal end of the lance at an injection point proximate to the bottom wall and introducing the polymeric binder into the .ion exchange resin through the lance;

(d) subsequently, repositioning the distal end of the lance within the container a plurality of times at points vertically above the previous injection point and again introducing the polymeric binder into the ion exchange resin; and (e) curing the polymeric resin.

14. The method of claim 13 further comprising displacing aqueous liquid from the ion exchange resin prior to the introduction of the polymeric binder by adding a displacement solution comprising a non-polar hydrophobic polymer into the container proximate to the upper wall, the displacement solution having a density that is less than 1, and removing aqueous liquid from a point proximate to the bottom wall of the container.

15. The method of claim 14 wherein the displacement solution comprises polyisobutylene.

16. The method of claim 15 further comprising forcing the displacement solution in an upward flow within the container upon the introduction of the polymeric binder and withdrawing the displacement solution from the container at a point proximate to the upper wall of the container.

17. The method of claim 16 further comprising positioning the container in an orientation other than vertical prior to the introduction of the polymeric binder.

18. An improved storage article for the safe containment of radioactive waste ion exchange resin, comprising:

a radioactive waste containment vessel containing a solidified matrix of polymerized epoxy-based resin within which is homogeneously distributed radioactive ion exchange resin and hydrophobic, non-polar polymer, wherein the non-polar polymer is chemically inert to the epoxy-based resin.

19. The article of claim 18 wherein the hydrophobic, non-polar polymer comprises polyisobutylene.

20. The article of claim 19 wherein the polyisobutylene forms a protective coating around the resin material thereby inhibiting chemical reaction between the resin material and the polymerized epoxy-based resin.

21. The article of claim 20 wherein the polymerized epoxy-based resin comprises epoxy resin and a amine curing agent for the epoxy resin.

* * * * *